United States Patent [19]

O'Neil

[11] 4,248,318

[45] Feb. 3, 1981

[54] RAILWAY CAR TRUCK LOAD INDICATOR

[75] Inventor: Gerald D. O'Neil, South Holland, Ill.

[73] Assignee: AMSTED Industries Incorporated, Chicago, Ill.

[21] Appl. No.: 98,703

[22] Filed: Nov. 29, 1979

[51] Int. Cl.[3] ..... B61F 5/06; B61F 5/52; G01N 5/00; G01G 19/08

[52] U.S. Cl. ..... 177/137; 105/197 R; 105/206 R; 105/207; 177/50

[58] Field of Search ..... 104/252; 105/197 R, 105/206 R, 207; 177/50, 225, 137

[56] References Cited

U.S. PATENT DOCUMENTS

| | | | |
|---|---|---|---|
| 243,150 | 6/1881 | Minck | 177/137 |
| 388,874 | 9/1888 | Howard | 177/137 |
| 695,890 | 3/1902 | Sinclair | 177/137 |
| 825,839 | 7/1906 | James | 177/137 |
| 3,190,383 | 6/1965 | Fountain | 177/137 |
| 3,285,195 | 11/1966 | Babson | 104/252 |
| 3,480,095 | 11/1969 | Tuchman | 177/137 |
| 3,967,578 | 7/1976 | Gallo | 177/225 X |

*Primary Examiner*—Howard Beltran
*Attorney, Agent, or Firm*—Fred P. Kostka; John L. Schmitt; Edward J. Brosius

[57] ABSTRACT

This relates to a load spring indicator for a railway car truck for indicating the load condition of springs supporting the bolster on the truck side frame. A reference is carried by the bolster and an indicator is carried by the truck side frame. The bolster reference is preferably the lower edge of the bolster gib or side rib while the indicator is an added plate or casting portion having an upper edge alignable with the lower edge of the bolster gib in the light condition of the car and a lower edge alignable with the bolster gib lower edge in the loaded condition of the car when the spring sets are of the proper strength and the car is not overloaded.

1 Claim, 2 Drawing Figures

RAILWAY CAR TRUCK LOAD INDICATOR

This invention relates in general to new and useful improvements in railway car trucks, and more particularly to a load spring indicator.

The ability of a railway freight car truck to properly protect the car structure as well as the lading is directly related to the spring group load coils having sufficient reserve capacity, which is determined by the amount of travel that is left in the springs from height at full load conditions to total deflection or a solid spring state.

Many factors can affect the spring groups ability to properly function in accordance with the intended design. These include spring capactiy loss from fatigue or broken coils. Further, cars may be loaded beyond the legal or design limit.

In addition to the standard double coil spring arrangement, a large number of railway cars being built at the present utilize triple load coils in the coil group. With a double coil, it is difficult to see if the inner coil is broken and with a triple coil arrangement, it is almost impossible to see the inner-inner coil. But it is also difficult to see some of the most important outer coils of the spring group, these being located in the center or rear of the group.

At the present time the only way to determine if the spring group has sufficient reserve travel is to dismantle the truck and check each coil, one at a time, in a machine designed for this testing. This is time consuming and is unnecessary.

In accordance with this invention, there is provided a visual, easily observed indicator on the side frame and a reference on the bolster which would indicate proper height for load coils at both light load car conditions and full loaded car conditions.

It will be readily apparent that the provision of a readily observed visual indicator would add to the safety of the railway car. A railway car truck without sufficient reserve travel is not safe and this condition should be corrected, whether the condition results from a defective load coil or car overloading.

With the above, and other objects in view that will hereinafter appear, the nature of the invention will be more clearly under stood by reference to the following detailed description, the appended claims and the several views illustrated in the accompanying drawings.

Figure 1:
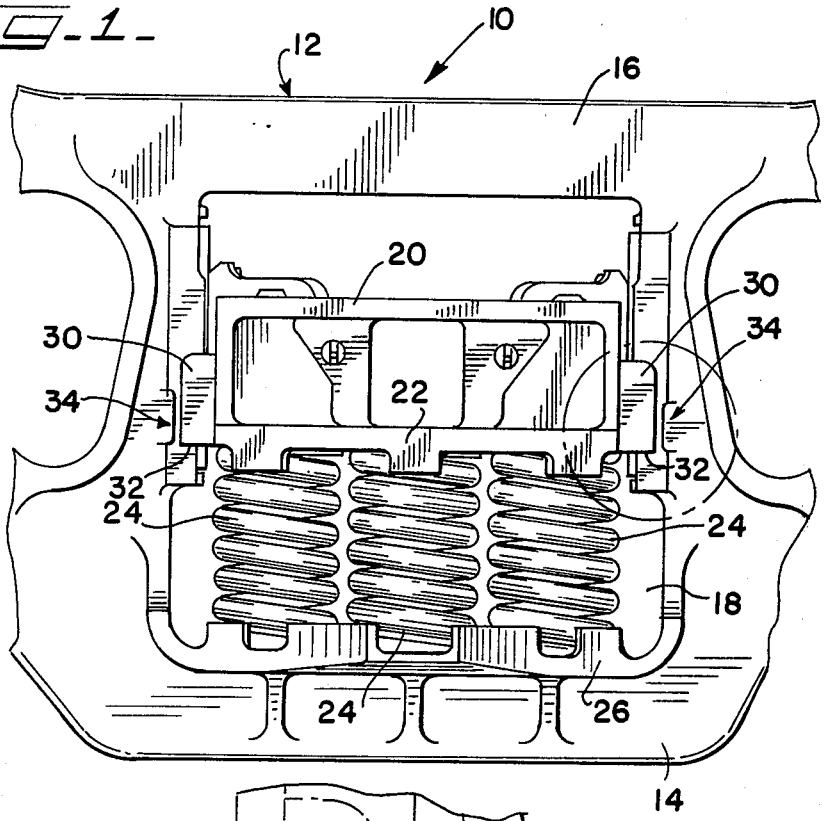
FIG. 1 is a fragmentary side elevational view of a car truck side frame and shows the mounting of the outer end of a bolster therein, the side frame and the bolster having cooperating indicator means.

Referring now to the drawings in detail, it will be seen that there is illustrated in FIG. 1 a railway car truck arrangement incorporating the invention, the car truck arrangement being generally identified by the numeral 10.

The car truck arrangement 10 includes a side frame 12 which includes a lower tension member 14 and an upper compression member 16. The tension member and the compression member are joined together by other portions of the side frame 12. The side frame 12 defines a relatively large, generally rectangular opening 18 which has received in the upper portion thereof an outer end of a bolster 20. The bolster 20 has mounted on the underside thereof a spring seat or cap 22 which rests upon a plurality of spring groups 24 which, in turn, are seated on a spring seat 26 carried by the tension member 14.

Although only three spring groups 24 have been specifically illustrated it is to be understood that the spring groups 24 may be arranged in double or triple rows transversely of the car. Further, although only one spring is illustrated, it is to be understood that each spring group 24 may include not only an outer spring, but also a inner spring and an inner-inner spring. Such springs will be arranged in telescoping relation.

As mentioned above, due to the arrangement of the springs, it is extremely difficult, except by way of a very careful inspection, to determine whether any of the springs are broken or missing, particularly the inner-inner springs. However, the absence or breakage of even an inner-inner spring may result in an undue loading of the other springs.

It is also to be understood that after a certain usage, particularly if there has been overloading, the springs may fatigue and will no longer support the intended load.

It is to be understood that when the springs are overloaded for their conditions, the coils of the springs will come into contact with one another and the spring will become a solid spring not capable of resiliently supporting a load.

Figure 2:
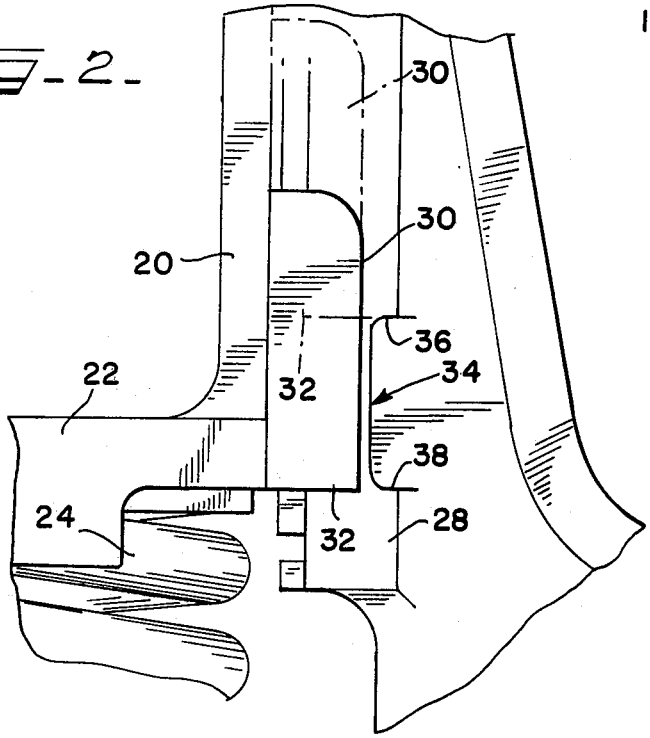
FIG. 2 is an enlarged fragmentary elevational view showing specifically the load spring indicator in accordance with this invention.

With particular reference to FIG. 2, it will be seen that each side of the opening 18 is defined by column guides 28 carried by the side frame and inner and outer bolster gibs or guide lugs 30 cooperating therewith. In accordance with this invention, a lower edge 32 of each bolster gib 30, particularly the ones disposed on the outer side of the truck, is utilized as a reference. The reference 32 is associated with an indicator 34 which is in the form of an added plate or a casting projection or recess from side frame 12. The indicator 34 has a preselected vertical length corresponding to the total compressibility of the spring groups 24 under normal loaded conditions. Each indicator 34 has an upper edge 36 which is vertically aligned with the reference edge 32 of the associated bolster gib in the light condition of the car. Each indicator 34 also has a lower edge 38 which is vertically alignable with the lower reference edge 32 of the associated bolster gib in a loaded car condition when the car's spring groups are new.

The indicator means formed of the reference 32 and the indicator 34 permits a quick visual inspection of the condition of the spring groups of the car truck even when the car is moving slowly. When the car is light, if the reference edge 32 is below the reference 36 of the indicator 34, this is a clear indication that either there is a broken or missing spring element or the springs do not meet the load or permanent set requirement. On the other hand, if the car is over loaded, this condition is readily observable upon a visual inspection as reference edge 32 will be below lower reference edge 38.

It will be readily apparent that the indicator provided in accordance with this invention eliminates the costly and timely disassembling of the car trucks so that the spring groups may be removed and tested in a mechanical tester. Testing is only required if there is an assurance of no overloaded condition and there is no evidence of broken springs. If there is no overloading or no broken springs, the odds are that the springs do not meet the load or permanent set requirement and therefore the truck is not disassembled without a useful purpose as occurs at the present. Further, with there being a readily readable indicator, the tendency for overloading cars will be greatly reduced.

Although only a preferred embodiment of the load spring indicator has been specifically illustrated and described herein, it is to be understood that minor variations may be made in the load spring indicator without departing from the spirit and scope of the invention as defined by the appended claims.

I claim:

1. A railway car truck load indicating arrangement including a truck side frame, spring sets carried by said side frame, a bolster having an end portion seated on said spring sets, a bolster jib having a lower edge providing a bolster loading reference, and a projection from the side frame having spaced upper and lower edges providing corresponding side frame references, said bolster reference when below the upper edge of the side frame reference, when the railway car is empty, indicating malfunctioning spring sets, and said bolster reference when below the lower edge of the side frame reference, when the railway car is loaded, indicating malfunctioning spring sets.

* * * * *